US005896435A

United States Patent [19]

Gautier et al.

[11] Patent Number: 5,896,435

[45] Date of Patent: Apr. 20, 1999

[54] PRESSURIZED WATER SUPPLY DEVICE FOR A STEAM INJECTOR WATER SOURCE

[75] Inventors: Guy-Marie Gautier; Patrick Aujollet, both of Pertuis, France

[73] Assignee: Commissariat a l'Energie Atomique, Paris, France

[21] Appl. No.: 08/822,220

[22] Filed: Mar. 21, 1997

[30] Foreign Application Priority Data

Mar. 25, 1996 [FR] France ..... 96 03680

[51] Int. Cl.[6] ..... F22D 11/00; G21C 11/25

[52] U.S. Cl. ..... 376/407; 60/644.1; 137/895; 261/76; 417/76; 417/79

[58] Field of Search ..... 376/298, 299, 376/372, 392, 407; 417/76, 77, 79, 158; 137/895; 261/76; 60/644.1, 646, 657

[56] References Cited

U.S. PATENT DOCUMENTS

| | | | |
|---|---|---|---|
| 4,232,703 | 11/1980 | Celi | 137/172 |
| 4,440,719 | 4/1984 | Howard | 376/407 |
| 4,687,626 | 8/1987 | Tong | 376/298 |
| 4,850,394 | 7/1989 | Imhof et al. | 137/554 |
| 5,398,267 | 3/1995 | Reinsch | 376/407 |

FOREIGN PATENT DOCUMENTS

A-30 05 643 8/1981 Germany .

*Primary Examiner*—Daniel D. Wasil

*Attorney, Agent, or Firm*—Pearne, Gordon, McCoy & Granger LLP

[57] ABSTRACT

The injector (B) designed specifically to supply a steam generator (G) with water at high pressure when necessary, is supplied by steam that may originate from the generator itself, and by pressurized water from an ejector (C) supplied during the start up phase by a water circuit (D) pressurized by steam, and during the steady state phase, by an extraction circuit (R) connected on the downstream side of the injector. This device entrains water originating from a tank at low pressure (73) into injector (B), to pressurize it at a pressure exceeding the steam pressure.

Application to safety devices in nuclear power stations.

13 Claims, 7 Drawing Sheets

PRESSURIZED WATER SUPPLY DEVICE FOR A STEAM INJECTOR WATER SOURCE

FIELD OF APPLICATION

The purpose of this invention is a device to inject water into a pressurized tank by means of a steam source. Usually, this pressurized tank is the steam boiler steam production tank. For example, this type of tank includes steam generators that are usually encountered in nuclear pressurized water reactors, or a boiling water reactor vessel, or any thermal power station generating steam. The advantage of this device is that it can inject water into these tanks producing steam by using the steam itself from a water tank kept at low pressure, for example atmospheric pressure. A particular application of this device is the standby supply for a nuclear power station steam generator.

STATE OF THE ART

One of the safety devices in a nuclear pressurized water reactor consists of a standby supply for steam generators. This standby supply is mainly used for elimination of residual heat when the nuclear reactor is shut down. The purpose of this supply is to provide the steam generator with water when the normal supply fails. The standby supply must be very reliable, due to the nature of its mission. In nuclear power stations, this standby supply is made using electric pumps or pump turbines. These devices are not easy to design due to rotating parts, and some are dependent on electrical sources. In order to make the standby supply to steam generators passive (i.e. to eliminate rotating parts and the electricity power supply), an attempt was made to use steam injectors. These devices use the energy in the steam in the steam generator to raise the pressure of the water in the low pressure tank to a pressure exceeding the steam pressure.

Firstly, we will recall the operating principle of a steam generator with reference to FIG. 1. Pressurized steam is inlet through pipe 1 and its pressure is reduced through a throttle 2 followed by a nozzle 3. At the end of this nozzle, the pressure of the cold liquid water is below the steam pressure. Usually, this water is inlet through an annular space 4. Water reaches this annular space through a pipe 14 in which there is a flow adjustment valve 15. In the rest of this description, the liquid water inlet through this pipe 14 will be called the injector source. Steam transfers its energy to the water mixing with it in the mixing chamber 5. This mixing chamber is usually conical shaped and converges to a throat 6. At this location, all the steam is condensed and mixing is complete, all the water is in the liquid state at very high speed, sometimes reaching the speed of sound. As it passes through throat 6, the high kinetic energy is transformed into pressure energy. The diffuser 7 at the exit from throat 6 increases the outlet pressure. The value of the pressure reached at the diffuser outlet 8 exceeds the driving steam inlet pressure at 1. This type of steam injector works very well for a steam pressure range less than 15 or 20 bars.

For higher pressures, the operation of this steam injector requires drains, i.e. removal of the water located in the mixing chamber 5. Thus the ENEL company in Italy presented a steam injector comprising two drains at Piacenza in Italy at the "European two phases Flow Top Meeting" in June 1994. This injector is shown in FIG. 1A. This Figure shows the same type of injector as in FIG. 1, but with two drains, one 10 located near the middle of the mixing chamber 5, and the other 12 located near the throat 6. In order to obtain a water pressure of several tens of bars at the injector outlet 8, a water source 14 is necessary with a slight pressure of a few bars and a small amount of water extraction at drain 12. The injector is fairly difficult to stir since during the priming period, water has to be extracted at drains 10 and 12 and the flows extracted at valves 11 and 13 have to be adjusted, and the flow at source 14 has to be adjusted, using valve 15. When the injector has been primed, drain 10 can be closed using valve 11. This injector continuously feeds the steam generator at a pressure of up to 60 bars, with a water source at a pressure of a few bars; however, the disadvantages of this injector are the difficulty of priming and maintaining a slight pressure on the source which makes it difficult to use a water tank at atmospheric pressure. This type of tank must be located a few tens of meters above the injector in order to maintain a slight pressure at the source. Furthermore, this injector is not very stable and is subject to depriming, which makes it insufficiently reliable.

Another injector avoids these disadvantages by using a water source at a pressure similar to the steam pressure. This device described in a presentation to the same conference in Plaisance consists of a steam injector of a type similar to the ENEL, but without the drains. This device is shown in FIG. 2. The steam generator A can be recognized with its steam supply 20, its water source 21, and its high pressure water outlet 22. The specific feature of the installation is that the water source is taken directly from the steam generator G. The water intake is in the part of the steam generator containing liquid water. Since temperature of this water is similar to the steam temperature, it must be cooled in the exchanger 26 immersed in a pool 33 before being used to supply the steam generator source 21. The injector is started up by opening a valve 27 at the inlet to a priming tank 28. Valve 30 allows water to pass in the direction of the arrow 32 with the effect of preventing the water contained in the steam generator G from exiting through pipe 31 while the injector is starting. In this installation, water outlet from injector 22 is at a pressure exceeding the steam pressure by a few bars, which means that it can be reinjected into the steam generator G through pipe 31. Therefore this installation can extract heat from the steam generator through the heat exchanger 26 which is immersed in pool 33. In this installation, the pressure in the water source is similar to the steam pressure since water and steam originate from the same steam generator. Unlike the previous injector, this system operates at a pressure of a few tens of bars without an extraction drain and without any difficulty in priming. However, like the previous injector, it cannot increase the water outlet from a tank at atmospheric pressure to a high pressure (a few tens of bars), so that it can be injected into the steam generator or for any other purpose. Due to its inherent design, this steam generator acts as a circulator, but not as a lifting pump to inject water from a low pressure tank into a pressurized circuit.

DISCLOSURE OF THE INVENTION

The purpose of this invention is precisely a device to supply a boiler with liquid using the energy contained in the same liquid when it is in vapor form. Throughout the rest of the description of this invention, it will be assumed that this liquid is water, and that the boiler is a steam generator in a nuclear pressurized water reactor. This same device may also be used in a boiler in a nuclear boiling water reactor, or in any other type of boiler producing steam.

Existing steam injection devices, like those described above, require a pressurized liquid water source which is obtained either through a pipe from the steam generator, or from a water tank placed several meters or tens of meters above the injector. This invention eliminates these disadvantages by creating a pressurized water supply for the steam injector source, characterized in that the water supply device comprises firstly, under start up conditions, at least one pressurized water supply circuit comprising a water tank pressurized by steam, an outlet pipe, and a non-return device, and secondly under steady state conditions, an ejector supplied with water at low pressure from a tank and with water at high pressure from an extraction circuit connected to the injector outlet.

Operation of the steam injector with this new source can give a significant improvement in the performances of current injectors. It is possible to obtain water at the outlet from the steam injector at a pressure exceeding the steam pressure, which can already be several tens of bars, starting from a water tank at very low pressure, for example atmospheric pressure, which current injectors are incapable of doing. The specific feature of the injector source is that it is at an intermediate pressure between the steam pressure and atmospheric pressure. Water supplying the source is taken from a low pressure tank and its pressure is increased initially by the steam pressure, and subsequently by the water pressure at the injector outlet. During start up and operation, the source pressure is maintained, eliminating drains and facilitating priming, so that the steam generator can be continuously supplied from a low pressure water tank.

DETAILED DESCRIPTION OF EMBODIMENTS OF THE INVENTION

Figure 1:
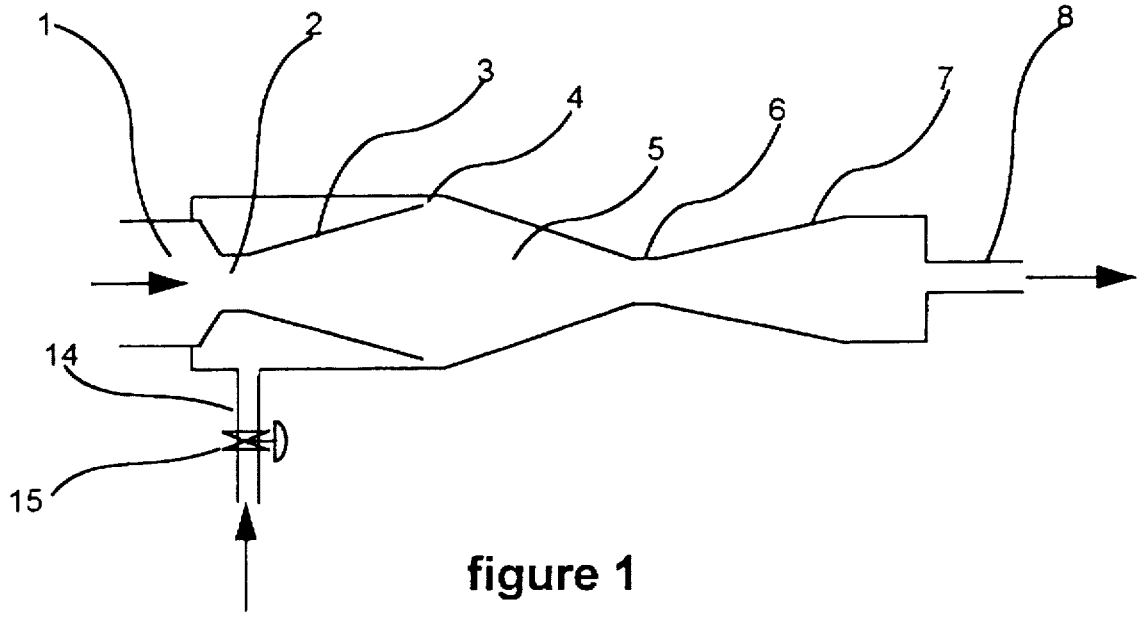
FIG. 1 describes the operating principle of a steam injector.
Figure 1A:
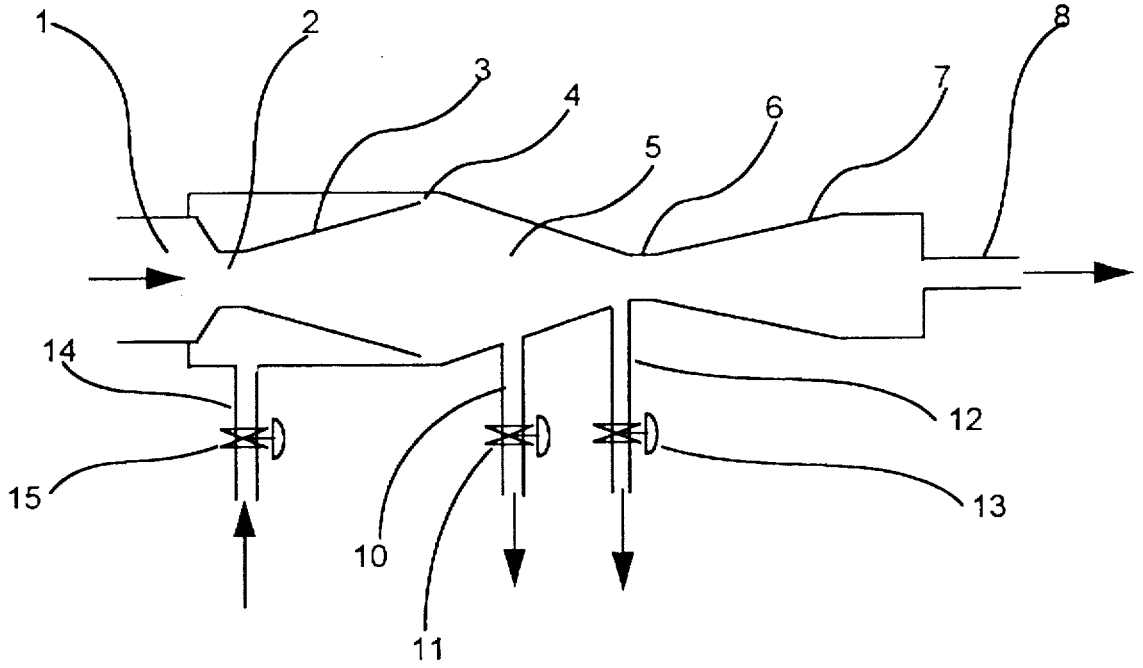
FIG. 1A describes the same type of injector as the previous Figure, but with the use of drains for use at a higher pressure.
Figure 2:
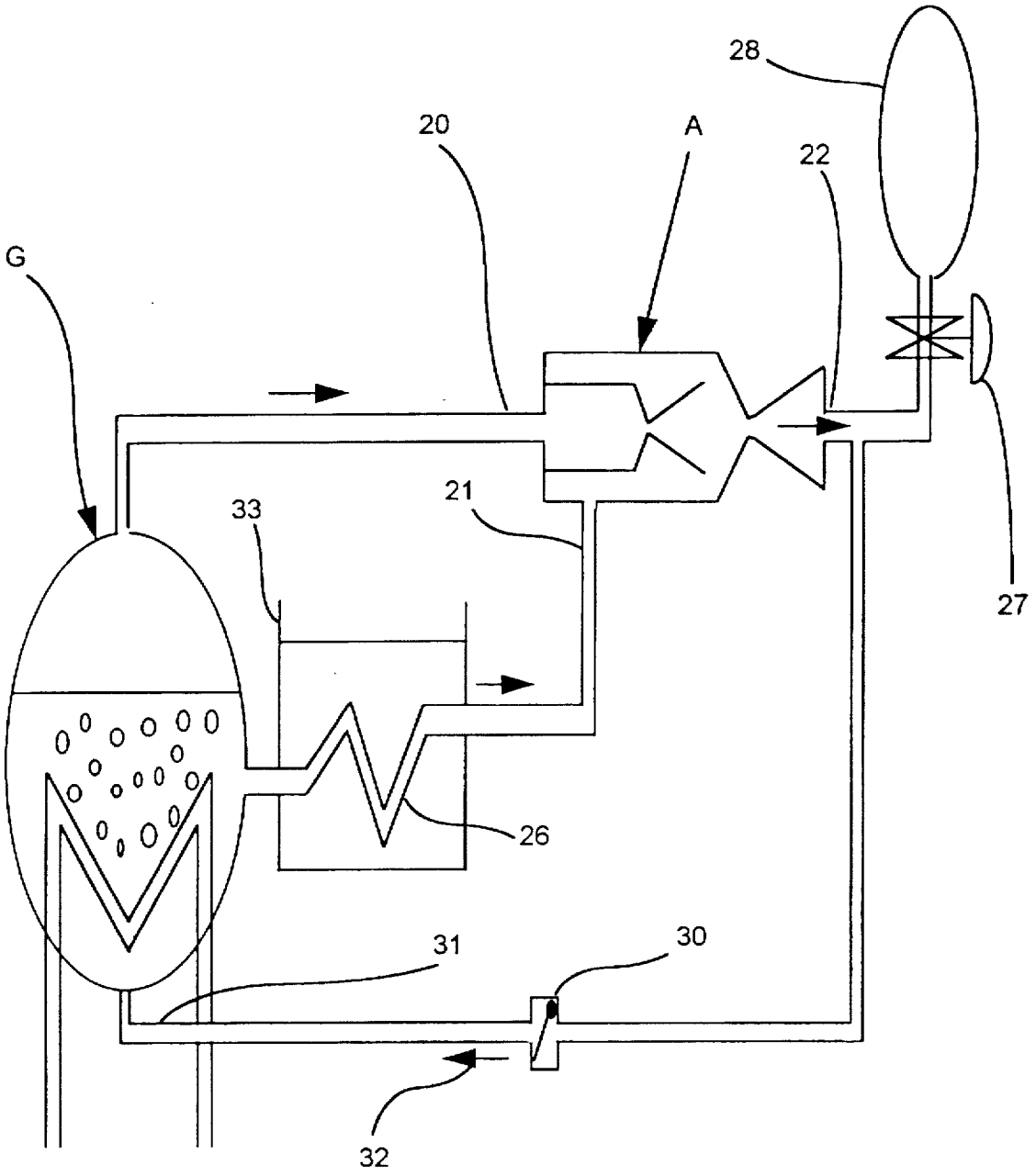
FIG. 2 describes an installation for removing heat from a steam generator to a pool by means of water circulation obtained using a steam injector.
Figure 3:
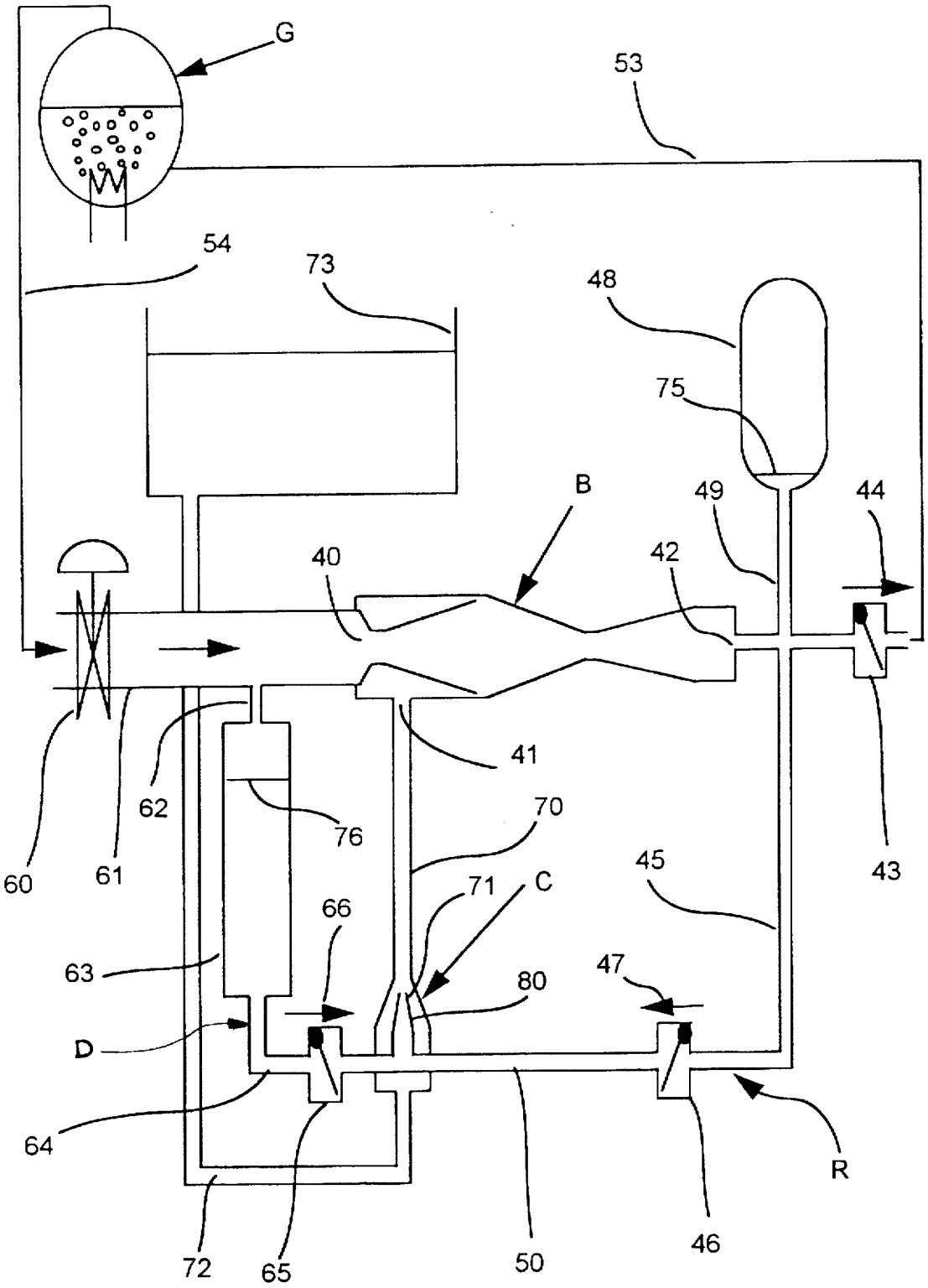
FIG. 3 describes the water supply device, i.e. the steam injector source, at an intermediate pressure between atmospheric pressure and the steam pressure.

FIG. 3 shows the steam injector B with its steam supply 40, its source 41 and its high pressure outlet 42. Outlet 42 is directed towards a high pressure water user, for example to a steam generator G, through a check valve 43 allowing water to pass in the direction of the arrow 44. Pipe 53 represents the link between the steam generator and the check valve 43 outlet. Part of the water at the high pressure outlet 42 is directed towards an ejector C through a pipe 45 and a check valve 46, allowing water to pass in the direction of the arrow 47. The outlet from this valve check passes through a pipe 50 to ejector C. A primer tank 48 is connected on the high pressure outlet 42 through a pipe 49. All pipes 45, 50 from check valve 46 and from ejector C form a return loop R to participate in the supply of the injector source 41.

The steam inlet is composed of a valve 60 which supplies the injector B with steam 40, through a pipe 61. Steam from steam generator G passes through a pipe represented by the link 54. A small cross-section pipe 62 is connected to pipe 61, and leads into tank 63, shown here as a pipe with a larger diameter than pipe 62. The end of this tank 63 is extended by a pipe 64 and a check valve 65, allowing water to pass in the direction of the arrow 66. This assembly forms a pressurized water supply circuit D during the start up phase. Water at the exit from check valve 65 passes into pipe 50 on the inlet side of ejector C.

Check valve 65 could also be placed on the tank 63 inlet pipe 62.

The steam injector B source 41 consists of pipe 70 which is connected to the outlet 71 of ejector C. This ejector receives its pressurized supply through pipe 50 and circuit D, and at low pressure by pipe 62 from a water tank 73. The low pressure can be obtained by opening tank 73 to the atmosphere.

The operating principle of this invention is as follows. Initially, when the injector is not in service, valve 60 is closed, all inlets and outlets for injector B and ejector C, and pipes connecting these components, are filled with water at a pressure similar to the water pressure in tank 73, which is open to the atmosphere. Check valve 43 prevents water in the steam generator from penetrating into the steam injector. The priming tank 48 is filled with a neutral gas, for example air, which remains trapped in it. This gas is at a pressure close to atmospheric pressure. The water level 75 is at the bottom of tank 48.

The injector is put into action simply by opening valve 60. When this valve is open, steam pushes the water contained in pipe 61 through the injector inlet 40, and through pipe 62 and tank 63. The steam acts like a piston on the water contained in the tank 63. A steam-water interface 76 is set up in tank 63. The water thus driven out passes out of the injector through outlet 42 and is gradually transferred into the priming tank 48, compressing the inert gas contained in this tank. The water in tank 63 is driven out through ejector C, then through pipe 70, and therefore through the steam injector source. Check valve 46 prevents the water from being flushed through the return loop R. Water from the tank 63 passes through the ejector at high speed due to the converging section 80, and entrains water from tank 73 through pipe 72, transferring part of its movement to it. Thus water outlet from the ejector originates partly from tank 63 which is always at steam generator pressure, and partly from tank 73 which is at atmospheric pressure. Therefore the injector source 41 is supplied by water at a pressure intermediate between the steam generator pressure and atmospheric pressure. The volumes of pipe 61 and tank 63 must be such that steam reaches the steam injector through its inlet 40, before the vessel is full of steam. The injector is primed in the same way as conventional injectors, and the pressure at outlet 42 starts to increase, gradually compressing the gas contained in tank 48. When the pressure at outlet 42 exceeds the pressure in the steam generator G, the check valve 43 opens, to supply it with water. Check valve 43 also opens under the effect of the pressure, at the same time as check valve 43. The pressure at the ejector inlet increases slightly and exceeds the pressure in tank 63 which is always at the same pressure as the steam. Consequently, check valve 65 closes. The ejector continues to operate by drawing in water from tank 73. The ejector driving fluid is no longer water in the vessel driven by steam, but is part of the water outlet from the injector. The injector is then operating in its steady operating state.

The injector is stopped by closing valve 60. The pressure in the injector, the ejector and the pipes connecting these components drops, check valve 43 closes, the water contained in tank 48 empties under the effect of the compressed gas and fills sections of the pipes still containing steam. This steam condenses when it comes into contact with the water. A few moments after valve 60 is closed, the entire installation returns to the initial configuration ready for a new start up.

Figure 4:
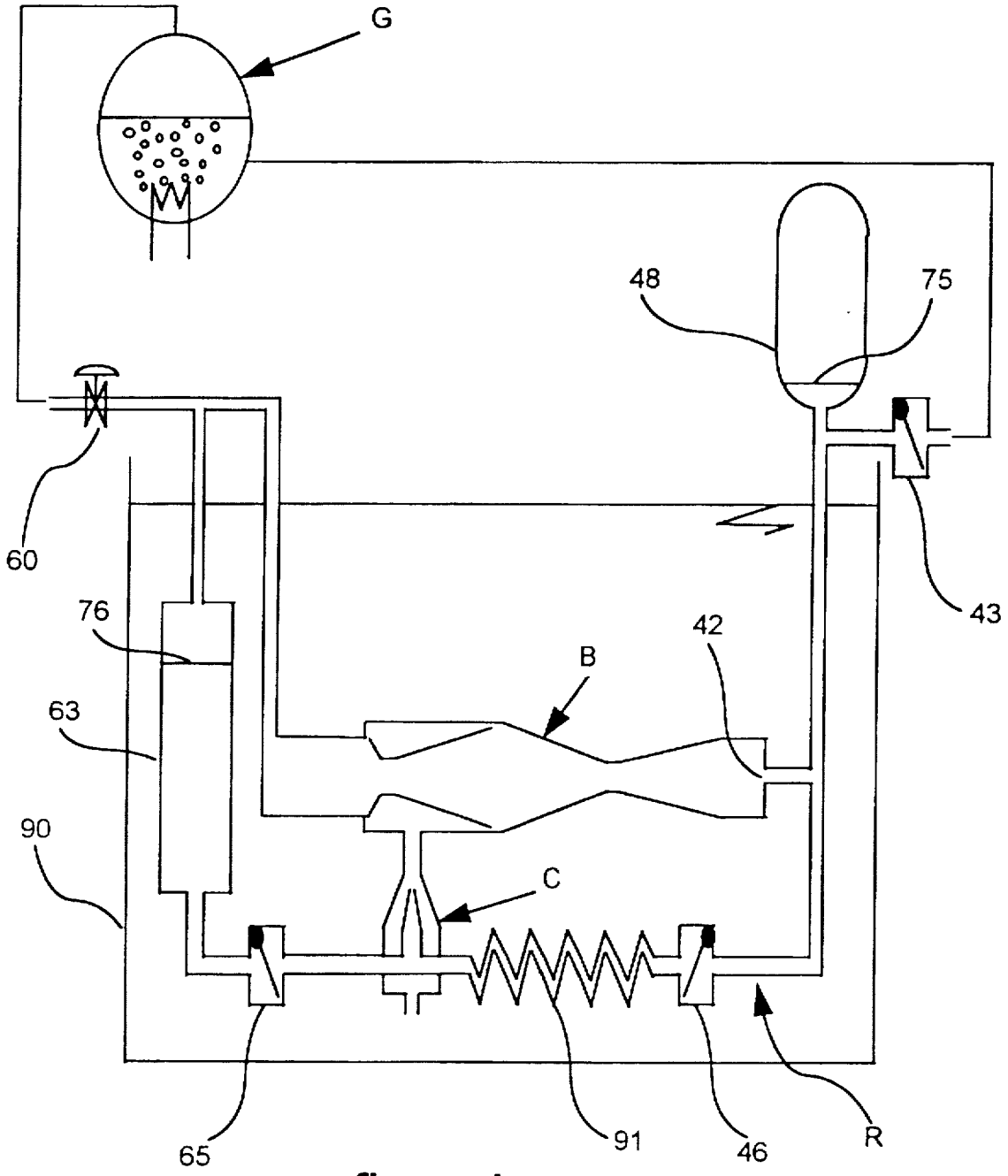
FIG. 4 describes the same device but with an injector, and its water supply system immersed in a pool.
Figure 4A:
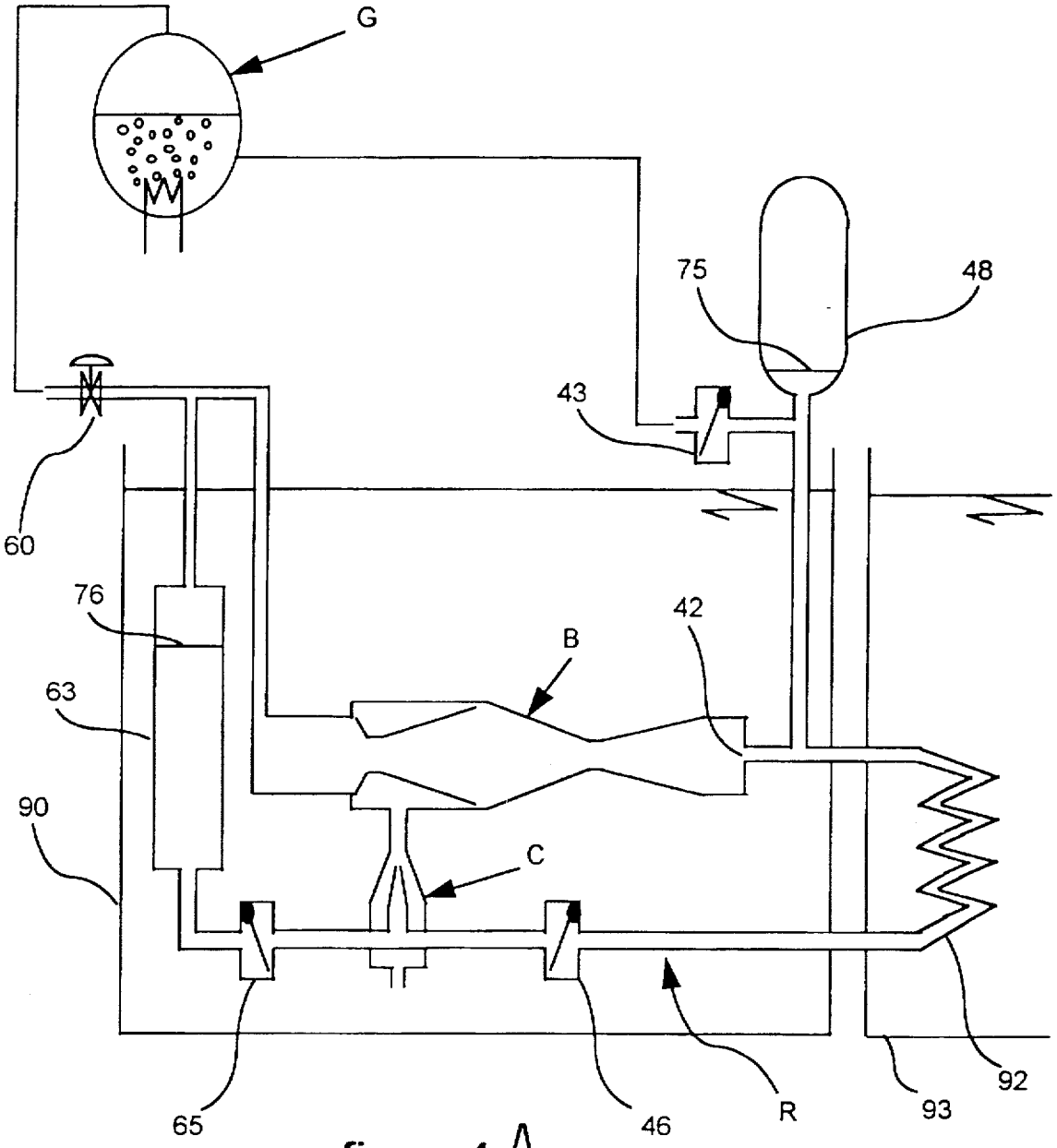
FIG. 4A shows the same device but with an exchanger on the return loop immersed in a pool independent of the pool in which the steam injector is immersed.

FIG. 3 shows an embodiment of the invention, and helps to understand its operation. FIG. 4 shows another embodiment of the invention, by immersing the main components in a pool 90 open to atmospheric pressure. On this FIG. 4, injector B, ejector C, tank 63 used for starting up by piston effect, check valve 65 between tank 63 and the ejector C, check valve 46 between the high pressure outlet from the injector and the ejector, are placed in the pool. Check valve 43 between the steam generator G outlet 42, priming tank 48 and valve 60 between the steam generator and the injector, have been placed outside the pool 90. Check valves, valves, tank 63 and primer tank 48 may be placed indifferently in or outside the pool, depending on the general layout of the embodiment. The advantage of placing the injector and its ejector in a pool is to save space: when they are placed in the bottom of the pool, the pressure at the source is increased by the static pressure due to the water height above these components. One condition for correct operation of the steam injector, particularly concerning the pressure increase, is the source temperature which must be as cold as possible. However the return loop R between the outlet 42 and the ejector carries hot water. This is cooled at the ejector by mixing with the cold water from the pool which is drawn into the ejector. If it is necessary to have a large increase in the pressure at the injector outlet 42, the injector source can be cooled by cooling the water circulating in the return loop R. This is done by placing a heat exchanger 91 on loop R. In FIG. 4, it was placed on the downstream side of check valve 46, but it could be placed on the upstream side of this valve depending on the embodiment layout: FIG. 4A shows the same layout as FIG. 4, except that the exchanger 91 in loop R has been moved. The purpose of this exchanger is to cool the flow circulating in loop R before mixing it in ejector C with water from pool 90, with the objective of obtaining the coldest possible water supplying the injector B source. The water in loop R therefore heats the water in pool 90 through exchanger 91. Eventually pool 90 warns up, and consequently the temperature of the water supplying the injector source also rises. When the temperature of the injector source is too high, the injector performances deteriorate. Thus to avoid this deterioration, an exchanger 92 was placed on the return loop R in FIG. 4A, in a pool 93 independent of pool 90. Water in the return loop R is cooled in pool 93, and the water in pool 90 remains cold such that a cold water supply for the injector source can be maintained and consequently the performances of the steam injector can be maintained.

Figure 5:
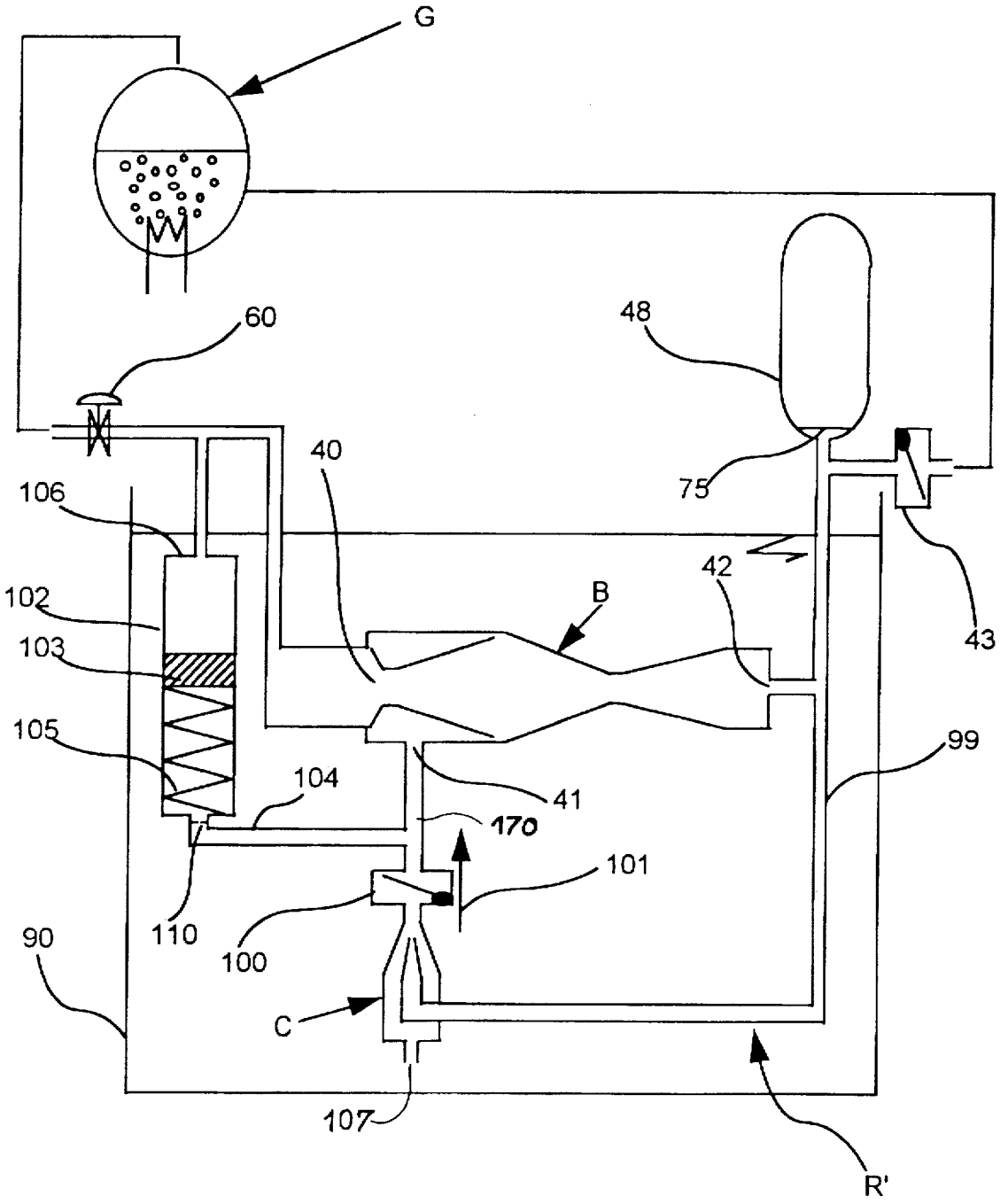
FIG. 5 describes a source water supply during the start up phase directly from a tank supplied by the steam.

FIG. 5 shows another device for pressurizing the source during the steam injector priming period. This Figure contains the main components already described on the previous Figures, namely the injector B, its high pressure outlet 42, its source 41, its steam inlet 40, the priming tank 48, the outlet check valve 43, the valve 60 and the steam generator G.

Loop R in FIGS. 3 and 4 is replaced by a loop R' comprising pipe 99 between the outlet 42 and the ejector C. In order to simplify the diagram, exchanger 91 on the return loop R is not shown on loop R' since it is not essential for operation. The high pressure supply of the ejector is made solely by the return loop R'. A check valve 100 on the outlet side of ejector C, the outlet of which is connected to source 41 through pipe 170, allows water to pass in the direction of the arrow 101. This check valve 100 replaces check valve 46 in FIGS. 3 and 4.

In this case the priming tank 63 which supplied the source 41 through ejector C is replaced by tank 102. This vessel has the same function of supplying the source during priming, except that this supply is made directly without passing through the ejector. Operation of this vessel must enable a supply of the source only during the start up period. We will now describe an embodiment of this tank 102, whereby it can fulfill its function, for illustration purposes. Tank 102 consists of a cylinder in which a piston 103 can slide. The exit 104 from this cylinder is connected to the check valve 100 outlet through the source 41 supply pipe 170. A spring 105 is located in the downstream part of cylinder 102. In FIG. 5, cylinder 102 is vertical and is immersed in pool 90. Depending on the available size for making this invention, the position of the cylinder may be arbitrary or may be outside the pool.

Before starting up the injector, all components between valve 60 and check valve 43 are filled with water, and are at the same pressure as the pool 90, except for the primer tank 48 which is filled with a neutral gas and its free level 75 is located in its lower part. Piston 103 pushed by spring 105 is at the inlet 106 to cylinder 102.

When valve 60 opens, steam drives water contained at the inlet to steam injector B, and pushes piston 103. Water in the part of the cylinder containing the spring is driven through pipe 104. It supplies the source 41, since it cannot pass through check valve 100. Most of the water driven by the steam or by the piston is directed into tank 48 through the injector B outlet 42, and compresses the gas in this vessel in order to gradually increase the pressure. The quantity of water that does not enter tank 48 escapes into the pool through loop R' and the low pressure inlet 107 to ejector C. This flow of water into the pool takes place provided that the injector outlet pressure does not exceed the pressure on the downstream side of check valve 100. This pressure on the downstream side of check valve 100 is equal to the steam pressure through cylinder 102 minus the pressure losses in pipe 104. These pressure losses must be adjusted as a function of the required operating conditions by placing a diaphragm 110 on the downstream side of the cylinder 102, for example at the inlet to pipe 104. When the pressure on the upstream side of check valve 100 exceeds the downstream pressure, the check valve opens, the ejector comes into action by entraining water at low pressure from pool 90 through its inlet 107. During the phase transferring the supply of source 41 from the cylinder to the ejector, the source is supplied by the cylinder and the ejector, as long as piston 103 pushed by the steam is not at the limit stop on the cylinder downstream outlet. When this phase is terminated, the source water supply is entirely from the ejector outlet at an intermediate pressure between the steam pressure and the pressure in pool 90.

The injector is primed when the mixing chamber in injector B is supplied partly by steam through inlet 40, and partly by water through source 41, and outlet 42 is at low pressure. This low pressure is obtained through the priming tank 48. The dimensions of cylinder 102 acting as the priming vessel must be such that the pipe on the upstream side of inlet 40 fills with steam much more quickly than cylinder 102. This condition must be satisfied so that the injector can be primed, followed by a pressure rise and then the source can be supplied by the ejector and the loop R' after being supplied through the cylinder.

Operation of the injector is stopped by closing valve 60. Check valve 43 then closes. All components between this valve and check valve 43 are filled with water due to expansion of the compressed gas in tank 48 and a spring 105 that replaces the piston in the upstream part of cylinder 102. The entire installation is in the initial conditions and is ready for a new start up.

Figure 6:
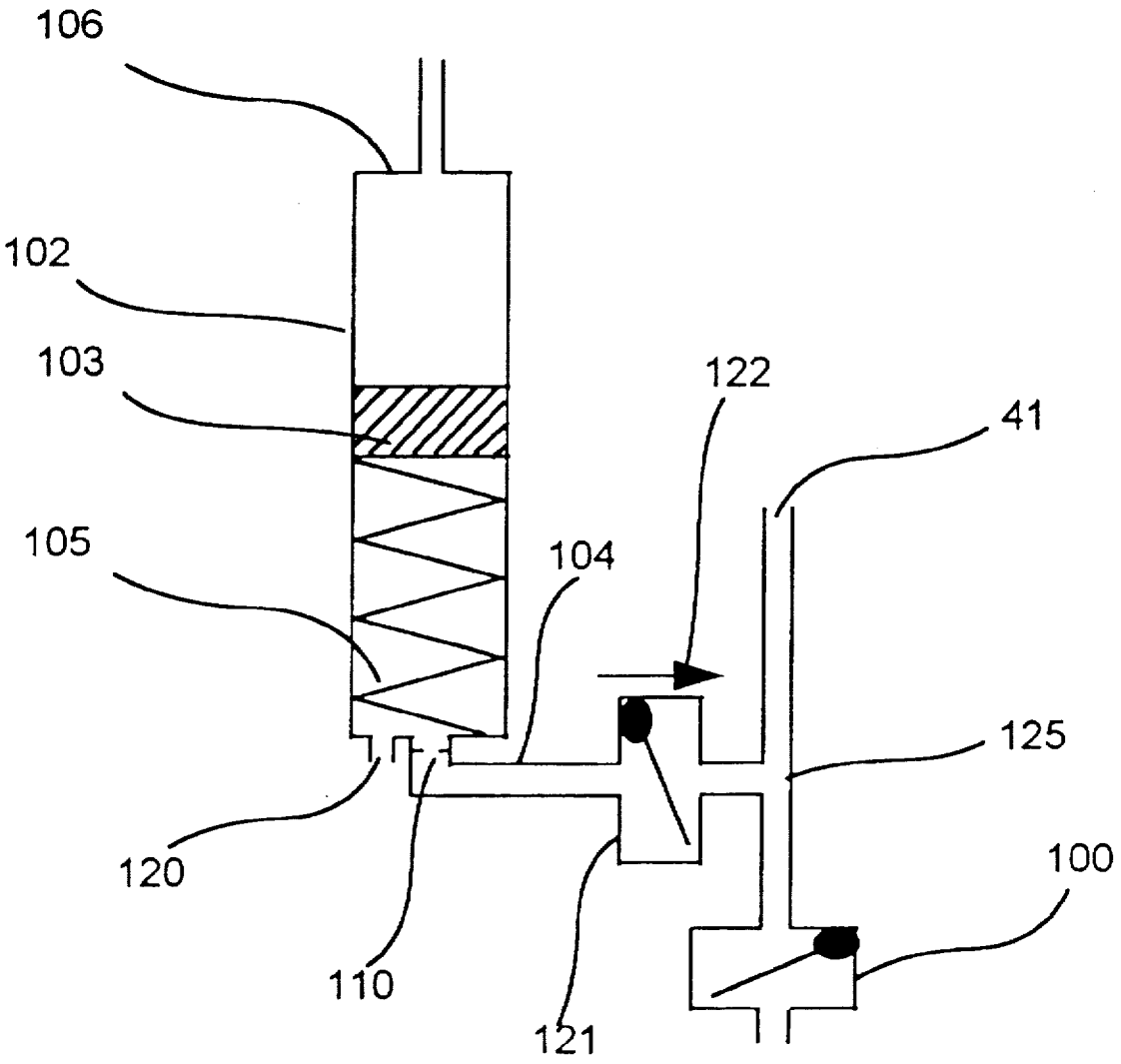
FIG. 6 describes a source supply device using steam, which is only used during the injector start up.

In FIG. 5, a diaphragm 110 adjusts the cylinder 102 outlet flow and pressure. FIG. 6 shows another way of adjusting this flow. For simplification reasons, we will only show tank 102 and its downstream part. In the part downstream from the cylinder, an orifice 120 with a small cross-sectional passage opens directly into pool 90, not shown on the Figure. The outlet pipe 104 comprises a check valve 121 that only allows water to pass in the direction of the arrow 122. This check valve is located before connection 125 to the pipe connecting the outlet of check valve 100 and the injector source 41. When the injector starts, i.e. when valve 60 is open, the water in tank 102 driven out by piston 103 is evacuated through pipe 104 and through orifice 120. Water passing through pipe 104 passes through check valve 121 before joining the source 21. The dimensions of the orifice 120 and the diaphragm 110 must be such that the flow and pressure at the source 41 are sufficient to enable priming. The diaphragm may possibly be eliminated, in order to satisfy this constraint. The function of check valve 121 is to prevent a leak on the flow supplying the source when it is supplied by the ejector through check valve 100. When operation of the injector is stopped, piston 103 returns to the upstream part of cylinder 102 under the action of spring 105. Water enters the downstream part of this cylinder through orifice 120.

We claim:

1. A source device for supplying a steam injector with pressurized water comprising an ejector active during a steady state injection phase, issuing to the injector, supplied with low pressure water from a tank, and supplied with high pressure water from an extraction circuit issuing to an outlet of the injector, wherein the source device comprises at least one pressurized water supply circuit active during a start up injection phase, issuing to the injector, and including a water tank pressurized by the steam for the injector and check valve means.

2. Pressurized water supply device according to claim 1, characterized in that the pressurized water supply circuit is connected to the ejector (C), and the extraction circuit (R) is fitted with a check valve (46).

3. Pressurized water supply device according to claim 1, characterized in that the low pressure water tank (73, 90) is open to the atmosphere.

4. Pressurized water supply device according to claim 1, characterized in that the pressurized water supply circuit is directly connected to a water supply pipe (170) of the injector and is isolated from the ejector (C) by a check valve (100).

5. Pressurized water supply device according to claim 1, characterized in that the check valve means (103) is a piston sliding in the water tank (102) and the water tank is cylindrical.

6. Pressurized water supply device according to claim 1, characterized in that the water tank (102) is fitted with a diaphragm (110) at an outlet.

7. Pressurized water supply device according to claim 1, characterized in that the extraction circuit (R, R') is connected to a gas tank (48) partially full of gas which remains trapped in said gas tank.

8. Pressurized water supply device according to claim 1, characterized in that the extraction circuit (R, R') is fitted with a heat exchanger (91, 92).

9. Pressurized water supply device according to claim 8, characterized in that the heat exchanger (92) is immersed in a cooling tank (93) distinct from the low pressure water tank (90).

10. Pressurized water supply device according to claim 1, characterized in that the water tank (63, 102) pressurized by steam, the injector (B), the ejector (C) and the extraction circuit (R, R') are immersed in the low pressure water tank (90).

11. Pressurized water supply device according to claim 10, characterized in that a heat exchanger (92) of the extraction circuit is immersed in a cooling tank (93) distinct from the low pressure water tank (90).

12. A source device for supplying a steam injector with pressurized water, comprising firstly, active during a steady state injection-phase, an ejector issuing to the injector and supplied with low pressure water from a tank and with high pressure water by an extraction circuit issuing to an outlet of the injector, wherein the source device comprises, active during a start up injection phase, at least one pressurized water supply circuit issuing to the injector and to a duct in which steam flows towards the injector, and comprising a water tank pressurized by the steam and check valve means between the ejector and the water tank.

13. A source device for supplying a steam injector with pressurized water, comprising firstly, active during a steady state injection phase, an ejector issuing to the injector and supplied with low pressure water from a tank and with high pressure water by an extraction circuit issuing to an outlet of the injector, wherein the source device comprises, active during a start up injection phase, at least one pressurized water supply circuit issuing to the injector and to a duct in which steam flows towards the injector, and comprising a water tank pressurized by the steam and check valve means between the ejector and the water tank, a valve means being comprised on the duct upstream from a point where the water supply circuit issues to the injector.

* * * * *